US008900509B2

(12) United States Patent
Mueller

(10) Patent No.: US 8,900,509 B2
(45) Date of Patent: Dec. 2, 2014

(54) CHARGING FRAME AND QUENCHING DEVICE HAVING A CHARGING FRAME

(75) Inventor: Bernhard Mueller, Kempten (DE)

(73) Assignee: Robert Bosch GmbH, Stuttgart (DE)

( * ) Notice: Subject to any disclaimer, the term of this patent is extended or adjusted under 35 U.S.C. 154(b) by 457 days.

(21) Appl. No.: 13/138,145

(22) PCT Filed: Dec. 2, 2009

(86) PCT No.: PCT/EP2009/066206

§ 371 (c)(1),
(2), (4) Date: Sep. 28, 2011

(87) PCT Pub. No.: WO2010/081588

PCT Pub. Date: Jul. 22, 2010

(65) Prior Publication Data

US 2012/0013056 A1 Jan. 19, 2012

(30) Foreign Application Priority Data

Jan. 14, 2009 (DE) ..... 10 2009 000 201

(51) Int. Cl.
*C21D 9/00* (2006.01)
*C21D 1/767* (2006.01)

(52) U.S. Cl.
CPC ..... *C21D 1/767* (2013.01); *C21D 9/0025* (2013.01)
USPC ..... 266/114; 266/250; 432/261

(58) Field of Classification Search
USPC ..... 266/250, 275, 114; 432/261
See application file for complete search history.

(56) References Cited

U.S. PATENT DOCUMENTS

| | | | | |
|---|---|---|---|---|
| 1,431,618 | A * | 10/1922 | Aderer | 432/261 |
| 2,296,380 | A * | 9/1942 | Davidson | 148/633 |
| 2,621,912 | A * | 12/1952 | Lyon et al. | 266/275 |
| 4,272,306 | A * | 6/1981 | Reisinger, Jr. | 148/206 |
| 4,351,314 | A * | 9/1982 | Morton | 126/59 |
| 4,634,103 | A | 1/1987 | Schmetz et al. | |
| 7,255,829 | B1 * | 8/2007 | Peter et al. | 266/250 |
| 2003/0175130 | A1 | 9/2003 | Loeser et al. | |

FOREIGN PATENT DOCUMENTS

| | | |
|---|---|---|
| CN | 1836054 | 9/2006 |
| DE | 295 12 569 | 11/1995 |
| DE | 296 03 022 | 4/1996 |
| DE | 101 17 987 | 10/2002 |
| EP | 0 129 701 | 1/1985 |
| EP | 1 154 024 | 11/2001 |
| JP | 57102556 | 6/1982 |
| JP | 61-181297 | 11/1986 |
| JP | 5-5171 | 1/1993 |
| JP | 5-87459 | 4/1993 |
| JP | 10-60524 | 3/1998 |
| JP | 2002-294333 | 10/2002 |
| JP | 2004-107705 | 4/2004 |
| JP | 2006-527351 | 11/2006 |
| WO | WO 2004/111562 | 12/2004 |
| WO | WO 2006/042538 | 4/2006 |
| WO | WO 2010/081588 | 7/2010 |

* cited by examiner

*Primary Examiner* — Scott Kastler
(74) *Attorney, Agent, or Firm* — Kenyon & Kenyon LLP

(57) ABSTRACT

A charging frame for accommodating a batch of parts to be quenched, e.g., metal workpieces, has a circumferentially closed peripheral wall which surrounds the batch and thereby forms a flow channel which prevents bypass flows. The charging frame is a part of a quenching device.

5 Claims, 2 Drawing Sheets

CHARGING FRAME AND QUENCHING DEVICE HAVING A CHARGING FRAME

BACKGROUND OF THE INVENTION

1. Field of the Invention

The present invention relates to a charging frame for accommodating a batch of parts to be quenched with the aid of a quenching gas, and also relates to a quenching device for quenching the parts, in particular metal workpieces.

2. Description of Related Art

To produce defined workpiece properties, such as a high degree of hardness or a sufficient wear resistance, most metal workpieces are subjected to heat treatment. The speed at which the previously heated workpieces are cooled is important for the treatment result. The use of water, oil or quenching gas is known for the necessary quenching process. The main advantage of using quenching gases instead of quenching liquids is the fact that the parts do not have to be cleaned following quenching as well as the fact that a higher quenching homogeneity within the batch may be achieved. However, to increase the quenching intensity to be achieved with the aid of quenching gas to the extent that this intensity lies in the range of liquids such as quenching oils or molten salt baths, it is necessary to achieve a very high heat transfer between the parts and the quenching gas amounting to more than 3,000 $W/m^2K$, which is possible only at very high flow rates. To achieve the necessary very high flow rates, in turn, the blower used must deliver very high volumetric flows and consequently requires a very high motor output. This is associated with high procurement costs as well as high energy costs during operation. When using blowers having a very high motor output, the problem arises that the pressure loss increases along with an increase in the flow rate within the batch and, as a result, a large part of the quenching gas does not flow through the batch but instead flows past the charging frame accommodating the batch. Thus, the flow rate within the batch; and thus also the quenching intensity, increases very little even though the blower's volumetric flow increases. In addition, conventional charging frames are constructed from gratings which are connected to rods extending in the vertical direction, which makes it possible for additional bypass flows to occur within the batch.

The use of gas nozzle arrays is known from published European patent document EP 0 129 701 B1 and published German utility model application document DE 29 603 022 U1 for increasing the quenching intensity. However, these nozzle arrays have the disadvantage that they produce high flow rates only in the area of the nozzle but not on average over the entire batch.

A quenching device is known from published European patent document EP 1 154 024 B1 in which an adjustable hood which has flow channels is situated in the quenching-chamber, it being possible to pass this hood over the parts accommodated in the charging frame for the purpose of preventing bypass flows. The disadvantage of the known quenching device is its complex construction. To this is added the need to provide moving parts, which are thus also susceptible to wear (hood, adjusting mechanism), in the quenching chamber.

BRIEF SUMMARY OF THE INVENTION

An object of the present invention is to increase the quenching intensity through simple and cost-effective means. The present invention is based on the idea of providing the charging frame with a circumferentially closed peripheral wall in such a way that lateral flow of quenching gas out of the charging frame is prevented. In other words, the charging frame is closed on the side; i.e., a kind of flow channel which prevents quenching gas from flowing out of the charging frame on the side of the parts is provided with the aid of the charging frame. The concentration of quenching gas flows achieved by providing the circumferentially closed peripheral wall makes it possible to achieve higher flow rates within the entire batch, consequently resulting in a higher quenching intensity. The peripheral wall is preferably dimensioned in the flow direction in such a way that the parts do not project over the peripheral wall. In contrast to the quenching device proposed in published European patent document EP 1 154 024 B1, the peripheral wall in a charging frame designed according to the concept of the present invention is an integral part thereof and does not have to be adjusted relative to the charging frame within the quenching chamber, which results on the whole in a much simpler construction of a quenching device provided with a charging frame described above. In particular, the circumferentially closed peripheral wall is preferably fixedly connected to a platform for holding the parts.

A specific embodiment of the charging frame is particularly advantageous in which the charging frame is at least partially, preferably largely, very preferably, in particular, completely made of carbon fiber-reinforced carbon (CFC), since this material remains dimensionally stable even under high thermal load and, due to its high specific strength, is able to absorb the high flow forces caused by the high flow rates resulting from the provision of the circumferentially closed peripheral wall.

In a refinement of the present invention, it is advantageously provided that the charging frame has a platform which is preferably fixedly connected and/or connectible to the peripheral wall for supporting the parts. The platform is preferably designed in such a way that it has a sufficiently large, freely passable surface portion. This may be implemented, for example, by providing the platform with a grate structure. The freely passable surface portion, enables quenching gas to flow through the charging frame. In designing the platform, it should be noted that the average flow rate within the batch is in reverse proportion to the freely passable surface portion (free cross-sectional area). The maximum flow rate within the batch may be adjusted in an X direction and a Y direction (horizontal plane) by varying the distances between the parts to be quenched.

It is conceivable to situate multiple platforms for the parts above each other and preferably oriented in parallel to one another, in this case the peripheral wall preferably extending over all platforms. However, a specific embodiment is very particularly preferred in which charging is carried out using only one layer of parts, since additional layers increase pressure loss and thus necessitate an even higher blower output. In addition, it has become apparent that the lower layers of parts are usually less effectively quenched.

The provision of a circumferentially closed peripheral wall, as described above, makes it possible to design or load the at least one, preferably only one, platform in such a way that the freely passable surface portion is less than 0.6 (in relation to the total area of the platform). It is particularly preferred if the freely passable surface portion is selected from a value range between 0.4 and 0.5 to ensure optimum charging, i.e., batch size. Implementing a small, freely passable cross-sectional area of this type permits much higher flow rates yet also results in correspondingly high pressure losses within the batch which, in turn, are acceptable due to the circumferentially closed peripheral wall.

A specific embodiment of the charging frame is particularly preferred in which the parts are freely situated within the peripheral wall, i.e., no separate flow channels are provided within the peripheral wall for each individual workpiece to be cooled. This embodiment results in a very simple charging frame construction and also enables the at least one, preferably only one, platform to be quickly loaded and unloaded. By dispensing with intermediate walls, which take up a lot of space, within the peripheral wall, it is possible to cool large batch sizes. In addition, this results in the advantage of easier loading, since the entire batch may be loaded and unloaded at once. The individual flow channels within the peripheral wall are preferably exclusively formed by the parts themselves, it being particularly preferred to space the parts a constant distance from each other and/or from the peripheral wall.

The present invention also relates to a quenching device for quenching parts, in particular metal workpieces, after previous heating, in particular for the purpose of influencing the material structure, for example, for the purpose of converting a face-centered cubic $\gamma$ lattice of carbon-rich austenite lamellae into a body-centered cubic $\alpha$ lattice of ferrite lamellae. The quenching device includes a quenching chamber, through which the quenching gas may be conducted, it being possible to accommodate at least one charging frame for holding the parts within the quenching chamber. The charging frame is very particularly preferably a charging frame which is provided with a circumferentially closed peripheral wall and is designed as described above. To form a flow circuit, the quenching device includes at least one flow channel which is fluidically connected to the quenching chamber as well as at least one blower for circulating the quenching gas/within the formed flow circuit, in addition to the quenching chamber. This blower is particularly preferably a radial blower. In the event that helium is to be used as the quenching gas, it is preferred to use a blower having an output of approximately 100 kW or higher for a standard batch area of 500 $mm^2 \times 500\ mm^2$ and a gas pressure of 20 bar. If nitrogen is used as the quenching gas, it is preferred to use a blower having an output of more than 700 kW. It is particularly preferred to use low-density quenching gases, for example helium or hydrogen, since the required blower output is proportional to the gas density. Gas mixtures having a high volume fraction of a low-density gas are favorable, for example gas mixtures of nitrogen and hydrogen or helium. A quenching device designed according to the concept of the present invention is characterized in that conducting means are assigned to the charging frame which are designed and situated in such a way that the entire quenching gas flowing through the charging frame is conducted into the flow channel. In other words, the conducting means establish a quenching gas-tight connection between the charging frame and the flow channel, in particular by providing an additional flow channel in the form of an attachment between the charging frame and the actual flow channel, thus preventing the quenching gas which has already flowed through the charging frame from flowing out into the quenching chamber on the side in an area below the lowermost platform of the charging frame. The resulting concentration of quenching gas flows may be used to optimize the flow rates.

A combination of the conducting means situated in an area between the charging frame and the flow channel and a charging frame designed as described above, which has a circumferentially closed peripheral wall, is very particularly preferred. The conducting means and the circumferentially closed peripheral wall are combined into a common flow channel situated within the quenching chamber, which prevents lateral flow of the quenching gas out of the charging frame. In other words, a construction of this type completely prevents bypass flows to the outside, and the entire volumetric flow is conducted through the batch without the need to provide a hood which has adjustable flow channels for each workpiece and which is situated within the quenching chamber. If the peripheral wall projects over the platform on both sides, the conducting means may also be formed by the section of the peripheral wall which projects downward from the platform, i.e., in the flow direction.

Different possibilities exist with regard to the arrangement of the conducting means. According to a first alternative, the conducting means are an integral part of the charging frame and extend from the preferably single, lowermost platform in the direction of the discharge opening of the flow channel. The conducting means are designed and situated in such a way that an at least largely, preferably completely, tight connection with the platform area of the quenching chamber may be established. In an alternative specific embodiment, the conducting means are an integral part of the quenching chamber and/or the flow channel, and the charging frame may be sealingly docked to the conducting means, which are preferably designed as the closed peripheral wall, preferably by placing or mounting the charging frame onto the circumferentially closed conducting means.

To optimize the efficiency of the quenching device, a specific embodiment is preferred in which a heat exchanger is situated in the flow circuit and may be used to remove the heat which has been selectively absorbed via the quenching gas.

It is very particularly preferred if a gas inlet empties into the flow circuit, preferably directly into the quenching chamber, it being preferably possible to conduct pressurized quenching gas from a high pressure tank through this gas inlet. Additional means for evacuating the quenching chamber are preferably provided.

In a refinement of the present invention, it is advantageously provided that the at least one, preferably the only one, blower is equipped with a rotational speed control device, preferably a frequency converter, for the purpose of limiting the starting currents. This offers the additional advantage that the blower output, and thus the flow rate, may be adapted to the required heat transfer coefficient of the particular batch.

The blower output, combined with the freely passable surface portion, preferably from 0.4 to 0.5, is preferably selected in such a way that a heat transfer of at least 3,000 $W/m^2K$ is achieved in the quenching gas used.

DETAILED DESCRIPTION OF THE INVENTION

Figure 1:
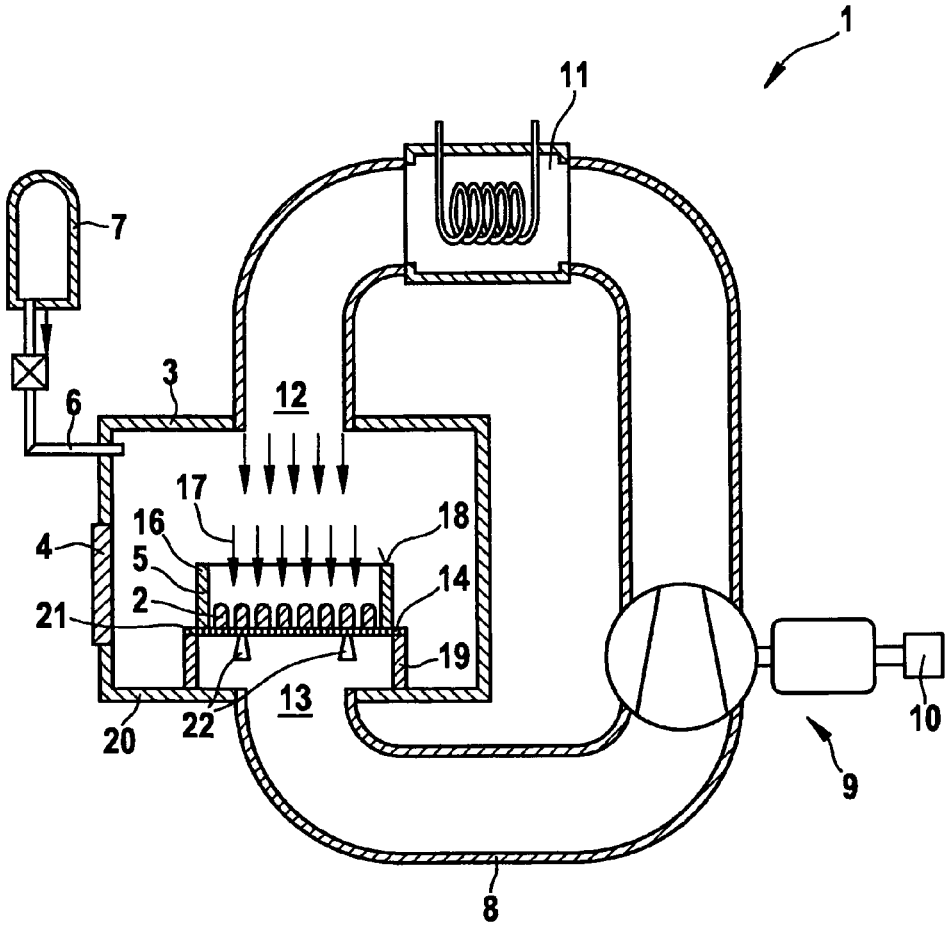
FIG. 1 shows a schematic representation of a quenching device having a charging frame.

In the figures, the same components and components having the same function are identified by the same reference numerals.

FIG. 1 shows a quenching device 1 for quenching parts 2, in this case metal workpieces. Quenching device 1 includes a quenching chamber 3 which has a pressure-tight door 4 (loading door) for loading and unloading quenching chamber 3 with the aid of a charging frame 5 which carries parts 2 and is made of a carbon fiber-reinforced carbon. A pressure gas line 6 for supplying quenching gas from a high pressure tank 7 empties into quenching chamber 3.

A flow channel 8, which forms a flow circuit for the quenching gas together with quenching chamber 3, is fluidically connected to quenching chamber 3.

A blower 9, which is designed as a radial blower, is situated in flow channel 8, a rotational speed control device 10 being assigned to this blower 9.

A heat exchanger 11 for removing heat from the quenching gas is furthermore located in flow channel 8. With the aid of blower 9, the quenching gas is accelerated and blown in the direction of heat exchanger 11, and the quenching gas enters quenching chamber 3 through an inlet opening 12 of flow channel 8, and leaves quenching chamber 3 through a discharge opening 13.

Figure 2:
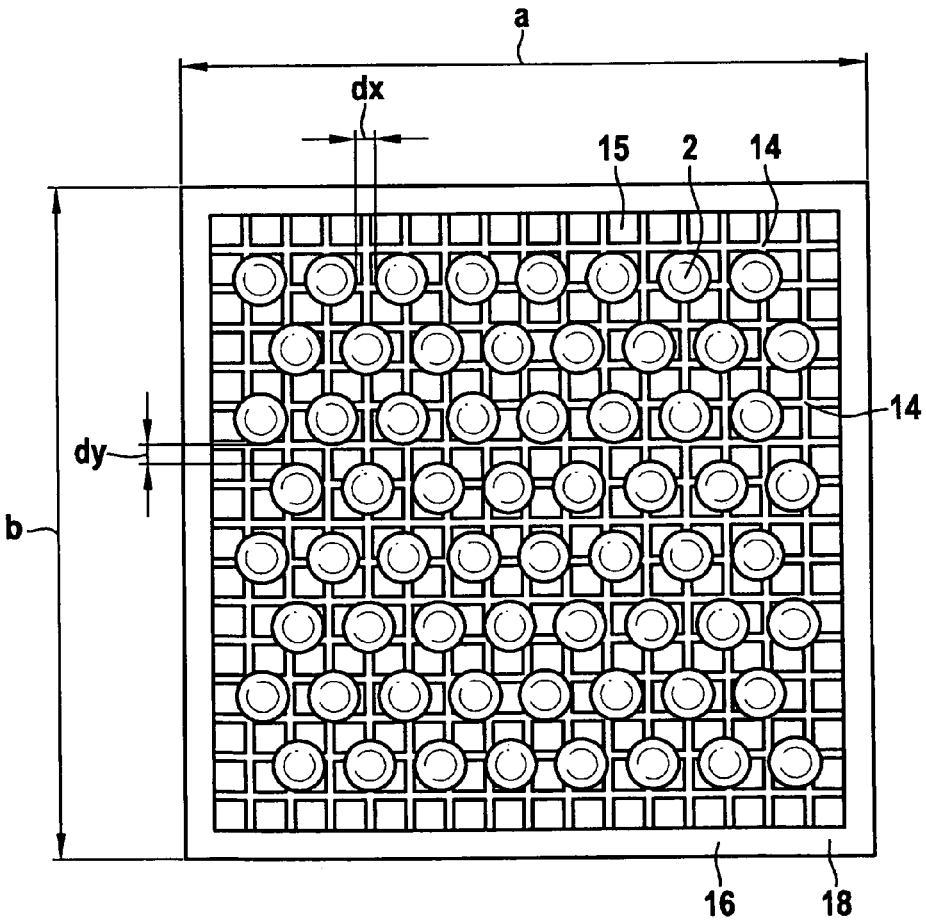
FIG. 2 shows a top view of a charging frame loaded with parts.

As shown in FIGS. 1 and 2, charging frame 5 includes a flat, grate-like platform 14 in which a plurality of through-openings 15 are provided. Parts 2 are placed on platform 14 at a distance dx from each other in an X direction and at a distance dy from each other in a Y direction. The dimensions of platform 14 are a=0.5 m in the X direction and b=0.5 m in the Y direction. The freely passable surface portion of platform 14 loaded with parts 2 is the ratio of the difference between total area a×b of platform 14 and the cross-sectional area of all parts 2 in relation to total platform area a×b. In the illustrated exemplary embodiment, the freely passable surface portion is selected from a value range between 0.4 and 0.5.

It is apparent that a circumferentially closed peripheral wall 16 extends perpendicularly to the surface extension of platform 14. In the illustrated exemplary embodiment, this peripheral wall 16 extends from platform 14 in the direction of inlet opening 12 and ends at a distance therefrom but projects over entire charging frame 5 counter to flow direction 17 of the quenching gas. Peripheral wall 16 thus concentrates the quenching gas and prevents it from flowing laterally out of charging frame 5 into quenching chamber 3.

As shown in FIG. 1, feet 22 are situated on platform 14 of charging frame 5 with the aid of which charging frame 5 may be positioned outside quenching chamber 3. Feet 22 project into an area within conducting means 19 in the flow direction.

FIG. 2 shows the circumferential contour of peripheral wall 16, which is square in the illustrated exemplary embodiment, whose upper end face 18 is situated at a distance from inlet opening 12, so that the quenching gas must flow directly through the quenching chamber on its way out of flow channel 8.

As is further shown in FIG. 2, charging frame 5 has no walls situated within peripheral wall 16 for forming separate flow channels for parts 2. The flow channels within peripheral wall 16 are formed exclusively by parts 2 and by parts 2 and peripheral wall 16.

To prevent the quenching gas flowing through platform 14 from flowing out laterally into quenching chamber 3, i.e., to conduct the concentrated quenching gas into flow channel 8, conducting means 19 are provided which are permanently integrated into the quenching chamber in the illustrated exemplary embodiment and which surround discharge opening 13 on the side. Conducting means 19 are designed in the manner of a circumferentially closed peripheral wall 16 which extends from a base area 20 (platform) of quenching chamber 3 to charging frame 5 counter to flow direction 17. Charging frame 5 rests tightly against a circumferential upper end face 21 of conducting means 19 without forming a gap, so that peripheral wall 16, together with peripheral wall-like conducting means 19, forms a forward flow channel which is situated upstream from actual flow channel 8, i.e., its inlet opening 12. Due to the back pressure forming outside charging frame 5 within quenching chamber 3, essentially the entire quenching gas volumetric flow enters flow channel 8 through charging frame 5.

What is claimed is:

1. A quenching device for quenching a plurality of parts using a quenching gas, comprising:

a quenching chamber;

at least one charging frame accommodated in the quenching chamber, the at least one charging frame having at least one platform section for holding the parts and a circumferentially closed peripheral wall surrounding the parts, wherein the at least one platform section has a freely passable surface portion, wherein the peripheral wall and the platform section are fixedly connected;

a flow channel fluidically connected to the quenching chamber for forming a closed flow circuit;

at least one blower configured to circulate the quenching gas in the flow circuit;

wherein the circumferentially closed peripheral wall forms a conducting section which conducts the entire quenching gas flowing through the platform section directly into the flow channel, wherein the conducting section is an integral part of the charging frame and is tightly accommodated in the quenching chamber; and a heat exchanger situated in the flow circuit and configured to remove heat from the quenching gas.

2. The quenching device as recited in claim 1, wherein the peripheral wall surrounding the parts is circumferentially sealed.

3. The quenching device as recited in claim 1, wherein a gas inlet empties into the quenching chamber.

4. The quenching device as recited in claim 1, further comprising:

a rotational speed control device assigned to the blower.

5. The quenching device as recited in claim 1, wherein an output of the blower is at least 700 kW.

* * * * *